US005974157A

United States Patent [19]

Tajima et al.

[11] Patent Number: 5,974,157

[45] Date of Patent: Oct. 26, 1999

[54] SMALL ELECTROACOUSTIC TRANSDUCER

[75] Inventors: Kazushige Tajima; Yoshio Imahori; Isao Fushimi, all of Shizuoka, Japan

[73] Assignee: Star Micronics Co., Ltd., Shizuoka, Japan

[21] Appl. No.: 08/824,543

[22] Filed: Mar. 26, 1997

[30] Foreign Application Priority Data

Apr. 11, 1996 [JP] Japan ..... 8-089816

[51] Int. Cl.[6] ..... H04R 25/00

[52] U.S. Cl. ..... 381/354; 381/417; 381/353

[58] Field of Search ..... 381/153, 154, 381/159, 192, 194, 190, 191, 337, 353, 354, 396, 398, 417, 431

[56] References Cited

U.S. PATENT DOCUMENTS

| | | | |
|---|---|---|---|
| 2,672,525 | 3/1954 | Pye | 381/417 |
| 3,819,879 | 6/1974 | Baechtold | 381/353 |
| 4,189,627 | 2/1980 | Flanagan | 381/353 |
| 4,504,703 | 3/1985 | Schneiter et al. | 381/191 |
| 5,416,751 | 5/1995 | Imahori | 381/192 |

*Primary Examiner*—Huyen Le

*Attorney, Agent, or Firm*—Pollock, Vande, Sande & Amernick

[57] ABSTRACT

The present invention provides a small electroacoustic transducer which is improved in sound characteristic by enlarging and adjusting a volume of a resonance space. A second resonant chamber as an auxiliary space is formed relative to a first resonant chamber formed in front of a resonance plate, wherein the first and second resonant chambers are connected with each other to enlarge the volume of the resonant volume.

5 Claims, 14 Drawing Sheets

SMALL ELECTROACOUSTIC TRANSDUCER

FIELD OF THE INVENTION

The present invention relates to a small electroacoustic transducer for producing an oscillation magnetic field based on electric signals, thereby converting the oscillation magnetic field into sound, particularly to an improvement of a resonance space.

PRIOR ART

A small electroacoustic transducer has been used as a sound means for paging users in a communication means such as a portable radio, a telephone or the like. FIG. 20 shows a conventional small electroacoustic transducer.

The small electroacoustic transducer produces an oscillation magnetic field based on electric signals which are applied to lead terminals 102 and 104 from an external device, and converts the oscillation magnetic field into sound. Electric signals are AC signals which are normally continuous pulses of current having a specific frequency. An outer casing 106 houses therein an oscillation magnetic field producing part 108 for converting electric signals applied to the lead terminals 102 and 104 into oscillation magnetic field, and a resonance plate 110 which is vibrated by the oscillation magnetic field produced in the oscillation magnetic field producing part 108. The oscillation magnetic field producing part 108 comprises an iron core 114 provided upright on a base 112 and a coil 116 wound around the iron core 114, wherein a free end of the coil 116 is connected with the lead terminals 102 and 104. A magnet 118 is provided around the coil 116, and a static magnetic field of the magnet 118 acts on the resonance plate 110. Since the resonance plate 110 is formed of a magnetic material, it receives attraction in one direction by the magnetic field of the magnet 118. There is defined a gap 120 between the resonance plate 110 and the iron core 114, so that a magnetic circuit is formed by the resonance plate 110 and the magnet 118. With such an arrangement, when the oscillation magnetic field acts on the resonance plate 110, the resonance plate 110 is vibrated, thereby producing sound.

A resonant chamber 122 is formed in front of the resonance plate 110, and serves as a space enclosed by the outer casing 106. The resonant chamber 122 has a function to resonate with the vibration of the resonance plate 110 and to convert the vibration into sound. The thus converted sound is discharged outside from a sound emitting hole 124 defined in the outer casing 106. The resonant chamber 122 formed in front of the resonance plate 110 forms a front space in front of the resonance plate 110 while a space formed in back of the resonance plate 110 is called as a back space. These front and back spaces influences sound characteristic such as sound pressure characteristic of the small electroacoustic transducer.

Incidentally, it is needless to say that the sound characteristic of the small electroacoustic transducer depends on the characteristic of components such as the outer casing 106 and resonance plate 110, namely, depends on materials or the sizes of such components. However, aiming to the resonant chamber 122 alone there is confirmed that sound pressure and sound are changed remarkably if the size of the resonant chamber 122 alone is changed while other components are shared with one another, namely, remain unchanged.

It is a current state that although the field of utilization of the small electroacoustic transducer is diversified, the electroacoustic transducer is forced to be installed in a very small space in a small electronic device and it is required to be more excellent than the conventional electroacoustic transducer in sound pressure, etc.

SUMMARY OF THE INVENTION

It is an object of the present invention to provide a small electroacoustic transducer which is improved in sound characteristic by enlarging and adjusting a volume of a resonance space.

In the small electroacoustic transducer of the present invention, as shown in FIG. 1A through FIG. 15, a second resonant chamber is formed as an auxiliary space relative to a first resonant chamber formed in front of a resonance plate, wherein the first and second resonant chambers are connected with each other to enlarge the volume of the resonance space. That is, the small electroacoustic transducer produces sound based on an oscillation magnetic field which is converted from electric signals, and it is characterized in comprising an oscillation magnetic field producing means for converting the electric signals into the oscillation magnetic field, a resonance plate forming a part of a magnetic circuit of the oscillation magnetic field producing means so as to produce mechanical vibration based on the produced oscillation magnetic field, a first resonant chamber formed in front of the resonance plate and in a space enclosed by the resonance plate and a wall member, said first resonant chamber producing sound upon reception of vibration of the resonance plate, and a second resonant chamber communicating with the first resonant chamber.

Since the second resonant chamber is provided so as to communicate with the first resonant chamber, it is possible to enlarge the volume of the resonance space, and possible to adjust the entire resonant volume depending on the volume of the second resonant chamber, so that the acoustic characteristic of the second resonant chamber is added to that of the first resonant chamber, thereby improving the acoustic characteristic.

Further, the small electroacoustic transducer of the present invention is characterized in comprising a sound emitting hole defined in the first resonant chamber for emitting sound outside the first resonant chamber, and wherein the second resonant chamber is provided in addition to the first resonant chamber for increasing the volume of the resonance space.

The factors of the acoustic characteristic can be changed by the volumes and shapes of the first and second resonant chambers, which results in the improvement of the acoustic characteristic.

Further, in the small electroacoustic transducer of the present invention, it is characterized in that the second resonant chamber is different from the first resonant chamber in resonance characteristic.

This is the problem of the positioning of the resonance characteristic of the second resonant chamber with respect to the first resonant chamber. Since the resonance characteristic of the second resonant chamber is differentiated from that of the first resonant chamber, respective resonance characteristics are compensated for each other, thereby realizing a desired acoustic characteristic and sound.

Still further, the small electroacoustic transducer of the present invention is characterized in comprising a sound emitting hole defined in the second resonant chamber for emitting sound outside the second resonant chamber.

It is arbitrary to establish the main and auxiliary relationship between the first and second resonant chambers, and the provision of the sound emitting hole in the first resonant chamber makes the first resonant chamber main relative to the second resonant chamber in respect of emission of the acoustic vibration outside the resonant chamber. Here, the sound emitting hole is provided in the second resonant chamber, and hence the sound can be emitted outside from the second resonant chamber.

Further, in the small electroacoustic transducer of the present invention, it is characterized in that the second resonant chamber is adjacent to the first resonant chamber and forms one or more spaces, and it selectively communicates with the first resonant chamber.

It is considered that the first resonant chamber is fixed, and the formation and volume of the second resonant chamber are arbitrary. With such a structure, the volume and characteristic of the resonance space can be set at the manufacturing stage and the adjusting stage without particularly changing the external appearance and the shape of the first resonant chamber.

The object, functions, advantage and the like will become more clear with reference to the following detailed description and the attached drawings.

DETAILED DESCRIPTION OF THE PREFERRED EMBODIMENT

The small electroacoustic transducer of the present invention will be now described in detail with reference to the attached drawings.

Figure 1C:
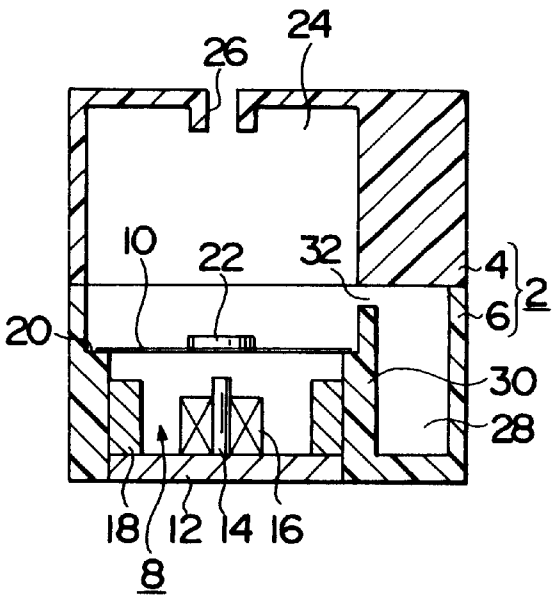
FIG. 1A, FIG. 1B and FIG. 1C are respectively cross sectional views of a small electroacoustic transducer according to a first embodiment of the present invention.
Figure 1B:
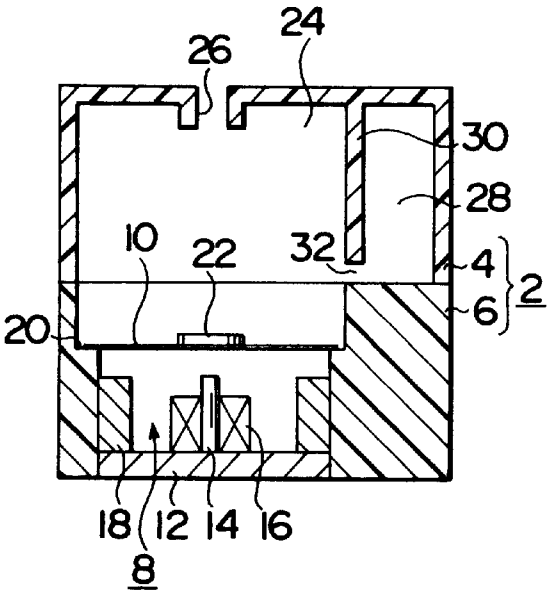
Figure 1A:
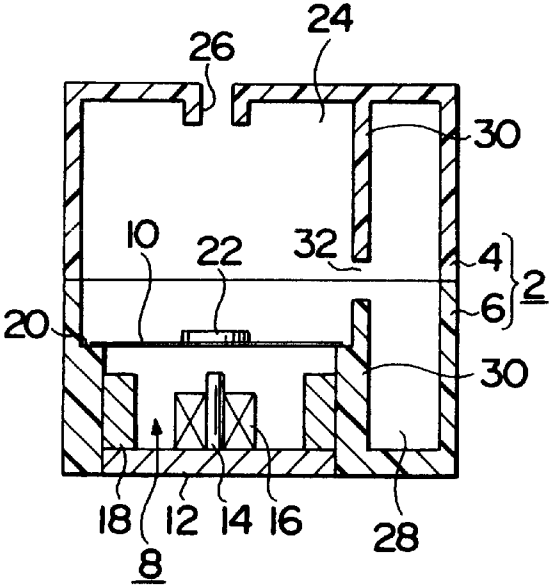

First Embodiment (FIG. 1 through FIG. 11):

FIG. 1A, FIG. 1B and FIG. 1C are respectively cross sectional views of a small electroacoustic transducer according to a first embodiment of the present invention. In each small electroacoustic transducer, an outer casing 2 is formed by jointing an upper case 4 and a lower case 6, and an oscillation magnetic field producing part 8 and a resonance plate 10 as an oscillation magnetic field producing means are provided in the lower case 6. The oscillation magnetic field producing part 8 is a means for converting electric signals applied to lead terminals, not shown, into oscillation magnetic field, and it includes a base 12, an iron core 14, a coil 16 and a magnet 18. The resonance plate 10 is formed of a magnetic material and is supported by a support stage 20 of the lower case 6 at its peripheral edge. A magnetic piece 22 as a weight is attached to the center of the resonance plate 10 for increase the mass thereof. A first resonant chamber 24 is formed over the upper surface of the resonance plate 10 by a space enclosed by the resonance plate 10, the upper case 4 and the lower case 6. The first resonant chamber 24 is open to the atmosphere through a sound emitting hole 26 defined in a ceiling of the upper case 4 whereby the sound produced in the first resonant chamber 24 is emitted outside through the sound emitting hole 26.

In the small electroacoustic transducer shown in FIG. 1A, a second resonant chamber 28 is formed by the upper case 4 and the lower case 6 adjacent to the first resonant chamber 24. A through hole 32 as a small pipe is defined in a wall member 30 for partitioning the second resonant chamber 28 and the first resonant chamber 24 wherein the first resonant chamber 24 and the second resonant chamber 28 communicate with each other through the through hole 32.

The small electroacoustic transducer shown in FIG. 1B has the second resonant chamber 28 in the upper case 4. In this case, the first resonant chamber 24 and the second resonant chamber 28 communicate with each other by the through hole 32 defined in the wall member 30 of the upper case 4.

The small electroacoustic transducer shown in FIG. 1C has the second resonant chamber 28 in the lower case 6. In this case, the first resonant chamber 24 and the second resonant chamber 28 communicate with each other by the through hole 32 defined in the wall member 30 of the lower case 6.

Described next is a function of the small electroacoustic transducer when the first resonant chamber 24 and the second resonant chamber 28 are formed.

It is possible to increase the volume of the resonance space as a whole in the small electroacoustic transducer since the second resonant chamber 28 is added to the first resonant chamber 24, thereby enhancing sound pressure characteristics. A plurality of second resonant chambers 28 may be provided wherein some of the second resonant chambers 28 are filled with an adhesive or the like, so as to adjust the number of the second resonant chambers 28, thereby adjusting the volume of the resonance space as a whole of the small electroacoustic transducer. That is, the second resonant chamber 28 is used for adjusting the resonance space, thereby changing or adjusting inherent resonant frequency, so that a small electroacoustic transducer having a desired acoustic characteristic is obtained.

It is possible to set the resonant frequency which is different from that of the first resonant chamber 24 by arbitrarily changing the resonant frequency of the second resonant chamber 28 connected with the first resonant chamber 24. The manner of setting of the resonant frequency can be arbitrarily performed by the shape of space, volume and the number of the second resonant chamber 28, and the manner of connection between the first resonant chamber 24 and the second resonant chamber 28. That is, if the volume of the through hole 32 is set to be smaller than the volume of the first resonant chamber 24 or the second resonant chamber 28, the first resonant chamber 24 and the second resonant chamber 28 can have the resonant frequency inherent thereto.

Figure 2:
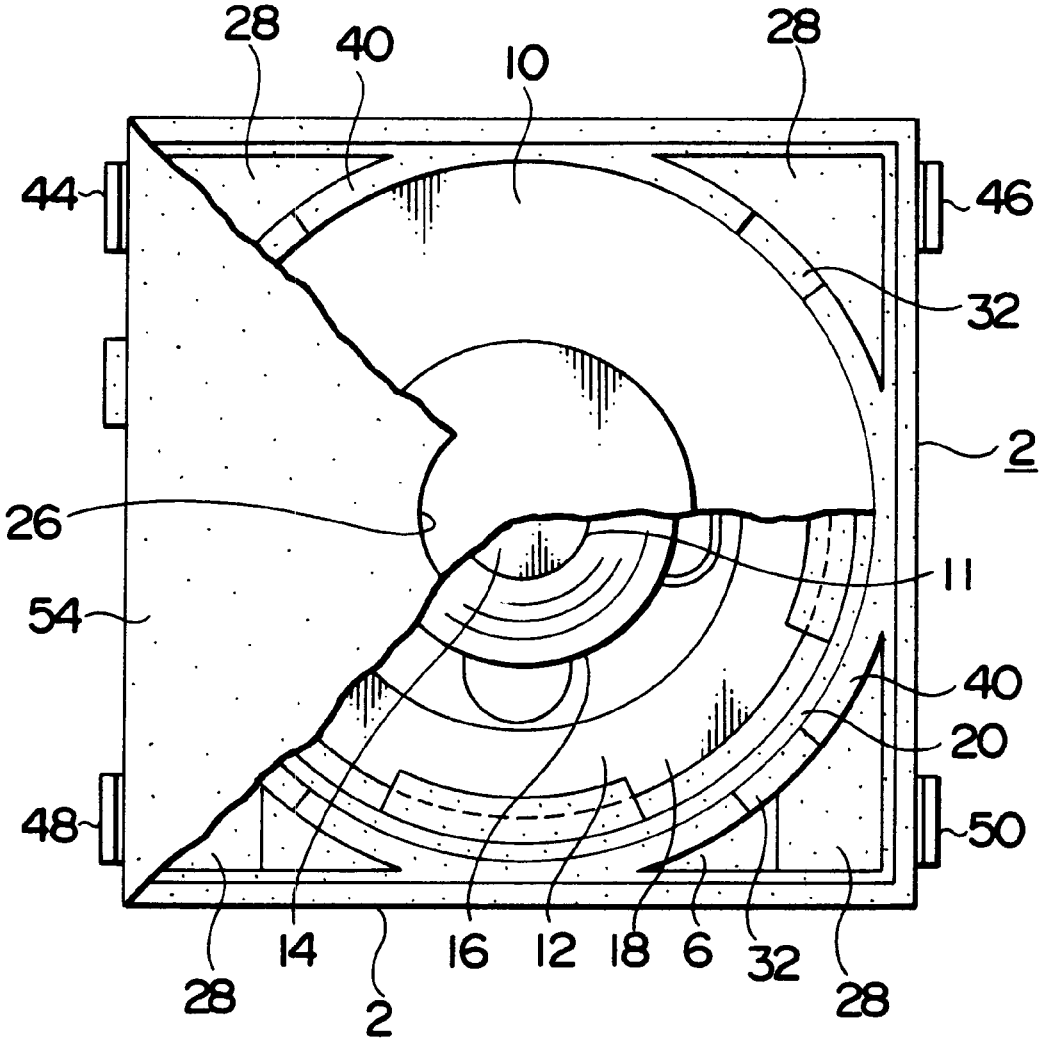
FIG. 2 is a plan view of the small electroacoustic transducer in which a part thereof is cut away.
Figure 3:
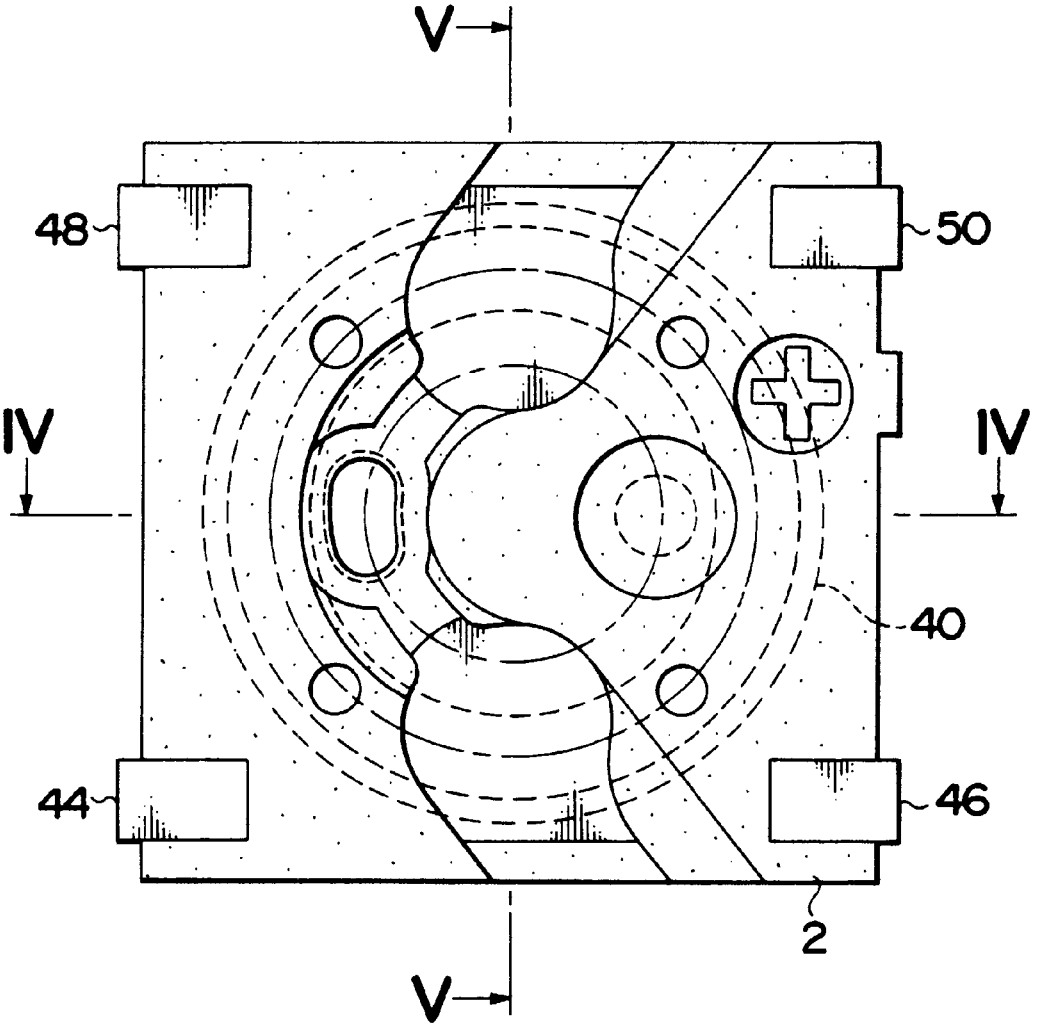
FIG. 3 is a rear view of the small electroacoustic transducer.
Figure 4:
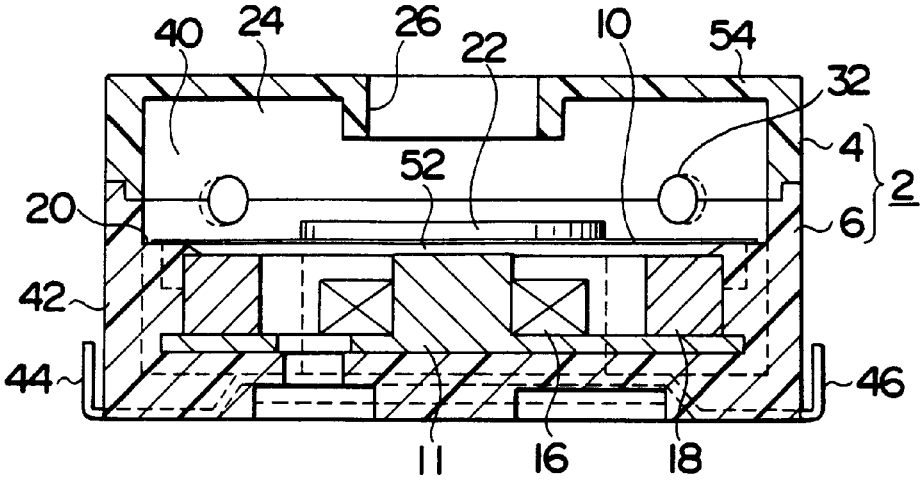
FIG. 4 is a cross sectional view taken along the line IV—IV in FIG. 3.
Figure 5:
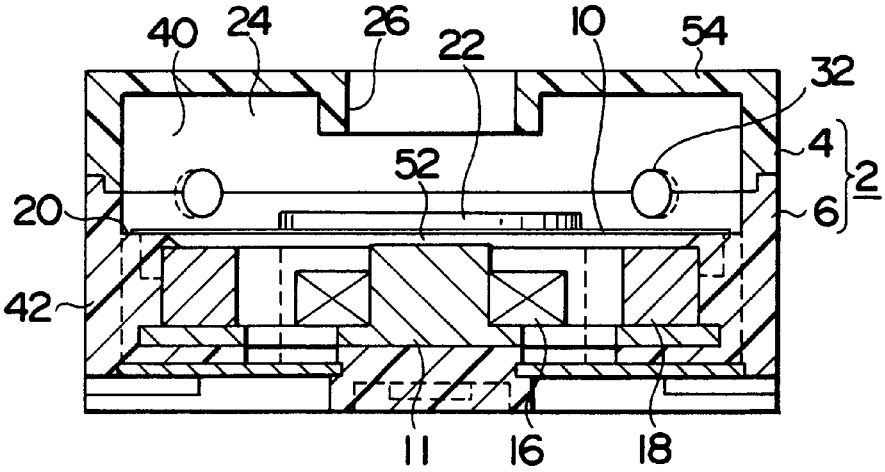
FIG. 5 is a cross sectional view taken along the line V—V in FIG. 3.

FIG. 2, FIG. 3, FIG. 4 and FIG. 5 respectively show the first embodiment of the invention in which FIG. 2 is a plan view of the small electroacoustic transducer wherein a part thereof is cut away, FIG. 3 is a rear view of the small electroacoustic transducer, FIG. 4 is a cross sectional view taken along the line IV—IV in FIG. 3, and FIG. 5 is a cross sectional view taken along the line V—V in FIG. 3.

The outer casing 2 comprises the upper case 4 and the lower case 6 which are joined to each other, wherein the upper case 4 and the lower case 6 are respectively formed of a resin material. The external appearance of the outer casing 2 corresponds to a space where the small electroacoustic transducer is mounted and it is normally a rectangular parallelepiped.

Serving as the cylindrical wall member, a cylindrical upright wall 40 is formed inside the upper case 4 and the lower case 6. The upright wall of the upper case has the same diameter as that of the lower case. The oscillation magnetic field producing part 8 for converting the electric signals into the oscillation magnetic field is housed inside the space enclosed by the upright wall 40 of the lower case 6. A pole piece 11 forming the oscillation magnetic field producing part 8 is formed by resin and fixed to the lower case 6, and it comprises the iron core 14 provided upright on the plate-shaped base 12 at the center thereof. The coil 16 is wound around the iron core 14, and the magnet 18 forming the magnetic circuit is brought into contact and fixed to the base 12 and is positioned around the coil 16. The magnet 18 is positioned by a plurality of protrusions 42 which protrude from the inner surface of the upright wall 40. Both ends of the coil 16 are connected with lead terminals 44, 46, 48 and 50 formed on the outer surface of the lower case 6 by way of a connecting means such as soldering.

The support stage 20 is formed on the upright wall 40 of the lower case 6 and the circular resonance plate 10 is provided on the support stage 20. The resonance plate 10 is a magnetic plate forming a closed magnetic path together with the iron core 14 and the magnet 18, and it is fixed by the attraction of the magnet 18. A gap 52 is defined between the iron core 14 and the resonance plate 10.

The first resonant chamber 24, which is enclosed by a ceiling 54 of the upper case 4, the upright wall 40 and the resonance plate 10, is formed over the resonance plate 10, and the sound emitting hole 26 is defined in the ceiling 54 of the upper case 4.

A plurality of second resonant chambers 28 serving as the second resonant chamber are formed between the upright wall 40, the upper case 4 and the lower case 6. In the first embodiment, since the cylindrical upright wall 40 is formed in the square outer casing 2, the four second resonant chambers 28 are formed on each cornered part of the outer casing 2. Each of the second resonant chamber 28 and the first resonant chamber 24 is connected with each other through the through hole 32 formed as a small pipe. That is, four second resonant chambers 28 are radially formed about one first resonant chamber 24 formed over the resonance plate 10.

Figure 6:
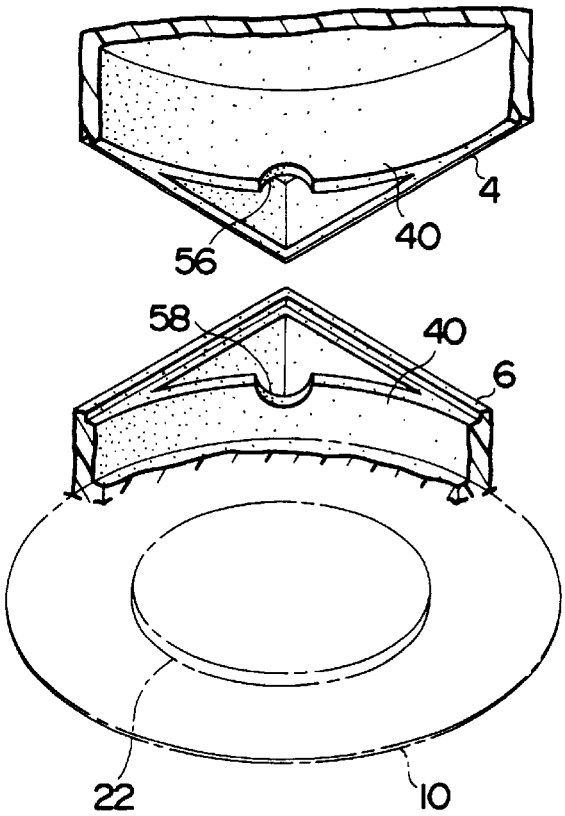
FIG. 6 is an exploded perspective view showing a shape of a second resonant chamber and formation of a small pipe.
Figure 7:
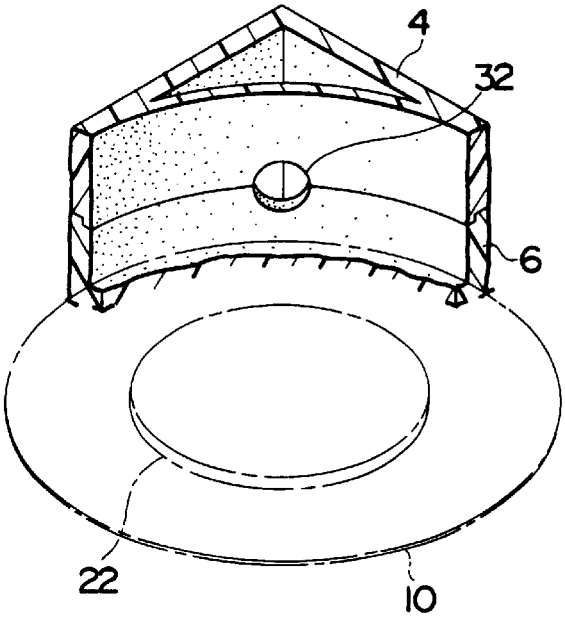
FIG. 7 is a perspective view showing the shape of the second resonant chamber and formation of the small pipe.
Figure 8:
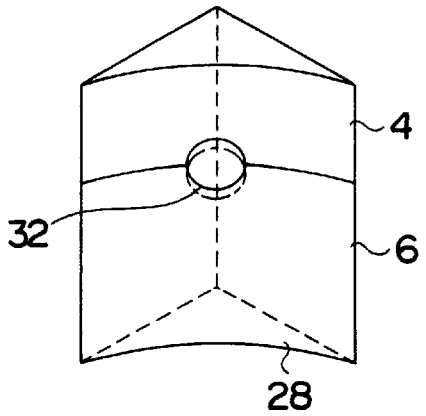
FIG. 8 is a perspective view showing an example of a second resonant chamber.

Semicircular notches 56 and 58 are formed at a joining part between the upright wall 40 of the upper case 4 and the upright wall 40 of the lower case 6 as shown in FIG. 6 and FIG. 7, wherein the circular through hole 32 is formed by these notches 56 and 58. In this case, the second resonant chamber 28 forms a space bridging the upper case 4 and the lower case 6 as shown in FIG. 8, and the second resonant chamber 28 is connected with the first resonant chamber 24 through the through hole 32 as a small pipe.

According to the present invention, the first resonant chamber 24 and the second resonant chamber 28 are connected with each other while the latter forms the second resonance space with respect to the former, the rectangular outer casing 2 can be accommodated in an excellent condition and fixedly secured in the space for the electroacoustic transducer in an electronic device. The first resonant chamber 24 is cylindrical with one side thereof being a diameter, and it can occupy the volume of the resonance space together with the second resonant chamber 28 even if there is a slight sacrifice of the volume by the upright wall 40. As a result, it is possible to improve a sound pressure characteristic and also an acoustic characteristic with the same mounting space as the prior art when the electroacoustic transducer is mounted.

Figure 9:
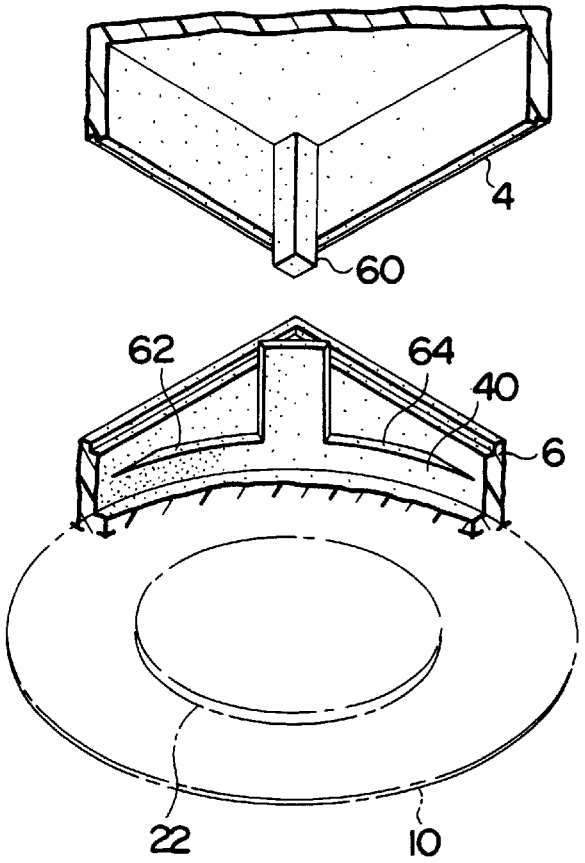
FIG. 9 is an exploded perspective view showing another shape of a second resonant chamber and formation of a small pipe.
Figure 10:
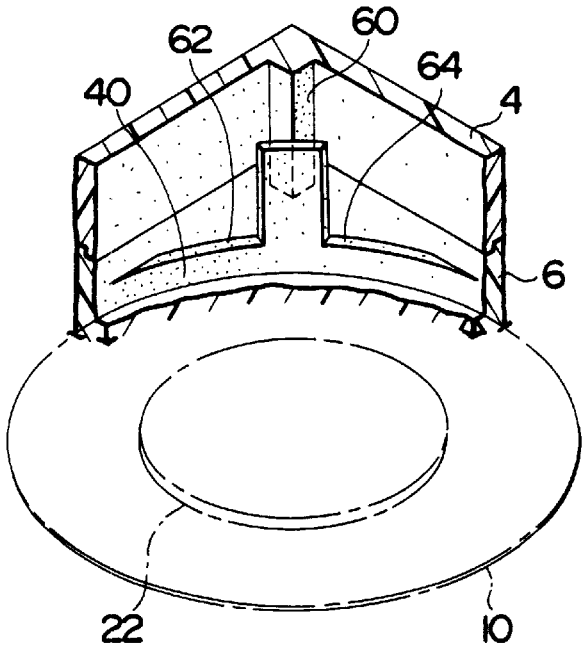
FIG. 10 is a perspective view showing the shape of the second resonant chamber and formation of the small pipe.
Figure 11:
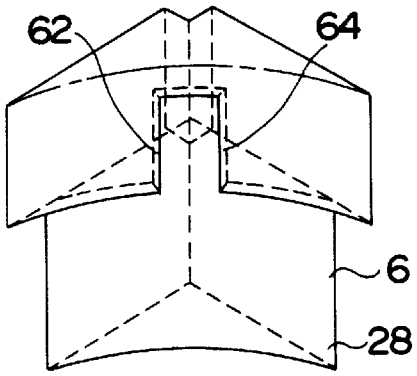
FIG. 11 is a perspective view showing the example of the second resonant chamber.

As shown in FIG. 9 through FIG. 11, the shape of the second resonant chamber 28 and the connection between the first resonant chamber 24 and the second resonant chamber 28 may be arranged as follows. That is, a support protrusion 60 is provided upright on the cornered part of the upper case 4 so as to be connected with the lower case 6, and an intermediate part of the upright wall 40 of the lower case 6 is extended so as to form notches 62 and 64 at the upper case 4 on both sides thereof, through which the first resonant chamber 24 and the second resonant chamber 28 communicate with each other. In this case, as shown in FIG. 11, the space in the upper case 4 functions as a small pipe, and the second resonant chamber 28 is formed at the lower case 6.

Figure 12:
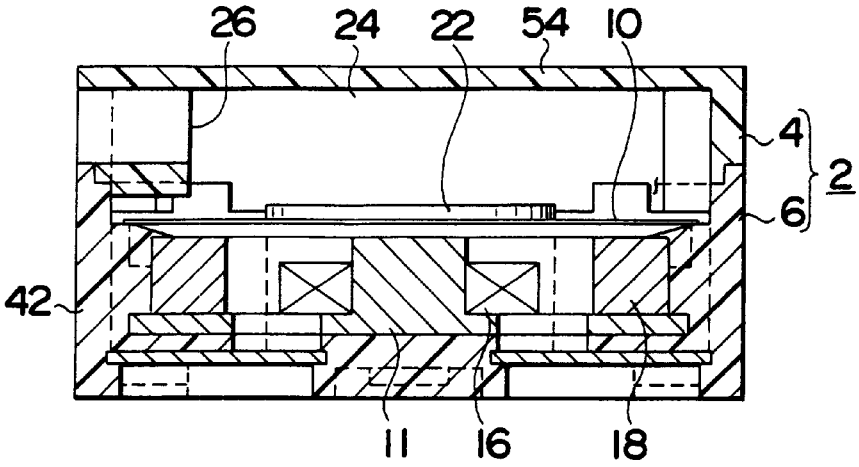
FIG. 12 is a longitudinal cross sectional view of a small electroacoustic transducer according to a second embodiment of the invention.
Figure 13:
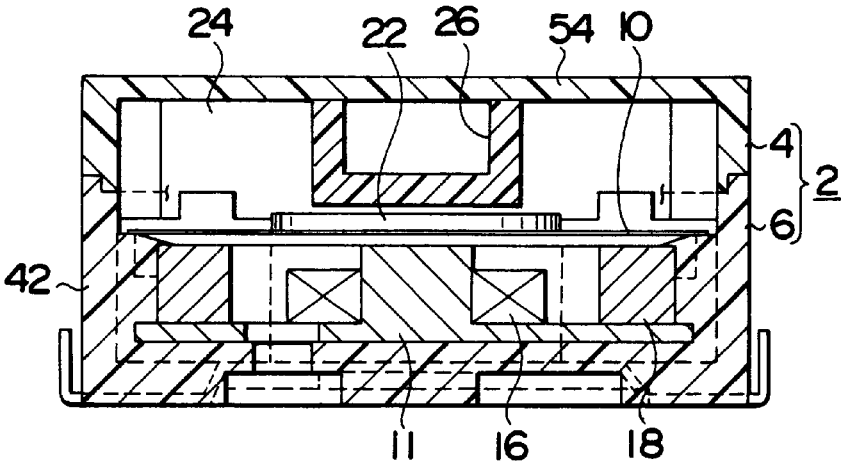
FIG. 13 is a longitudinal cross sectional view of the small electroacoustic transducer in which the small electroacoustic transducer of FIG. 12 is cut at right angles.

Second Embodiment (FIG. 12 and FIG. 13):

Although the sound emitting hole 26 is defined in the ceiling 54 of the upper case 4 in the first embodiment, the sound emitting hole 26 may be defined in one side of the upper case 4 forming the first resonant chamber 24 while the ceiling 54 forms the closed wall of the first resonant chamber 24, wherein the sound may be emitted from the side of the outer casing 2. Even in such an arrangement of the small electroacoustic transducer, it is possible to obtain the same acoustic characteristic as the first embodiment.

Figure 14:
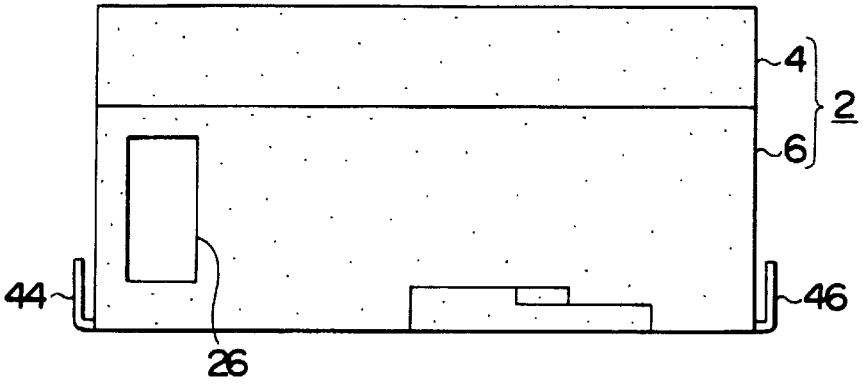
FIG. 14 is a side view of a small electroacoustic transducer according to a third embodiment of the invention.
Figure 15:
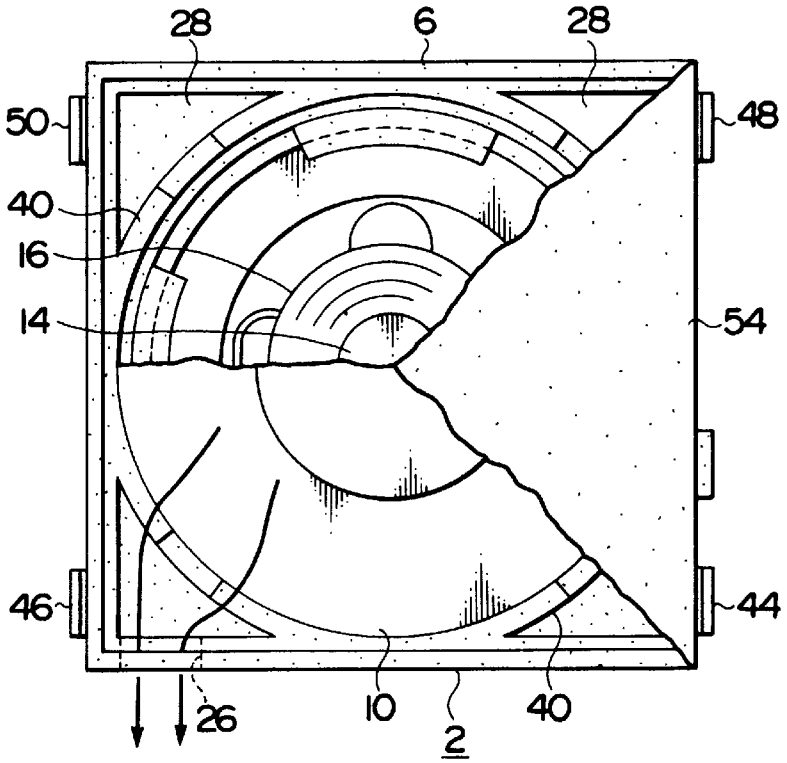
FIG. 15 is a plan view of the small electroacoustic transducer in which the small electroacoustic transducer of FIG. 14 is partly cut away.

Third Embodiment (FIG. 14 and FIG. 15):

Although in the first and second embodiments, the sound emitting hole 26 is formed in the first resonant chamber 24 but it may be formed in the second resonant chamber 28 as shown in FIG. 14 and FIG. 15. Even in such an arrangement, it is possible to obtain the same acoustic characteristic as the first and second embodiments. In addition to such an acoustic characteristic, it is possible to form the sound emitting hole 26 at the side of the outer casing 2 without enlarging the outer casing 2, thereby flattening the small electroacoustic transducer and also reducing the mounting space of the small electroacoustic transducer.

The acoustic characteristic of the small electroacoustic transducer according to the first, second, and third embodiments will be now described with reference to FIG. 2 through FIG. 5.

The acoustic characteristic is tested in the following 5 cases by commonly applying an input signal to the small electroacoustic transducer, namely, in the case of (a) utilizing all four second resonant chambers 28, (b) utilizing three second resonant chambers 28 while one second resonant chamber 28 is closed, (c) utilizing two second resonant chambers 28 while two second resonant chambers 28 are closed, (d) utilizing one second resonant chamber 28 while three second resonant chambers 28 are closed, (e) utilizing the first resonant chamber 24 alone while the four second resonant chambers 28 are closed.

Figure 16:
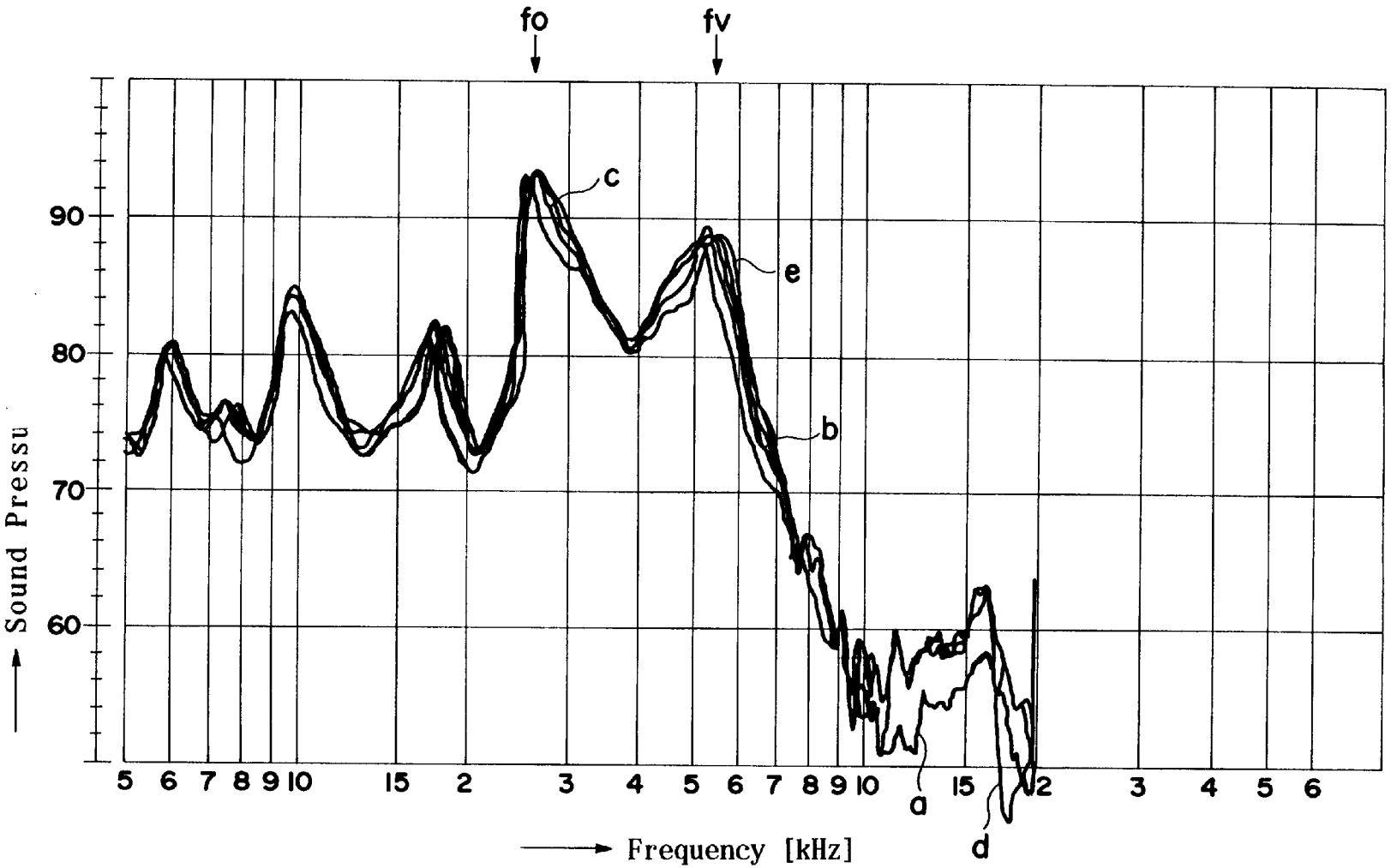
FIG. 16 is a view showing the relationship between a sound pressure and a frequency characteristic of the small electroacoustic transducer according to the first to third embodiments of the present invention.
Figure 17:
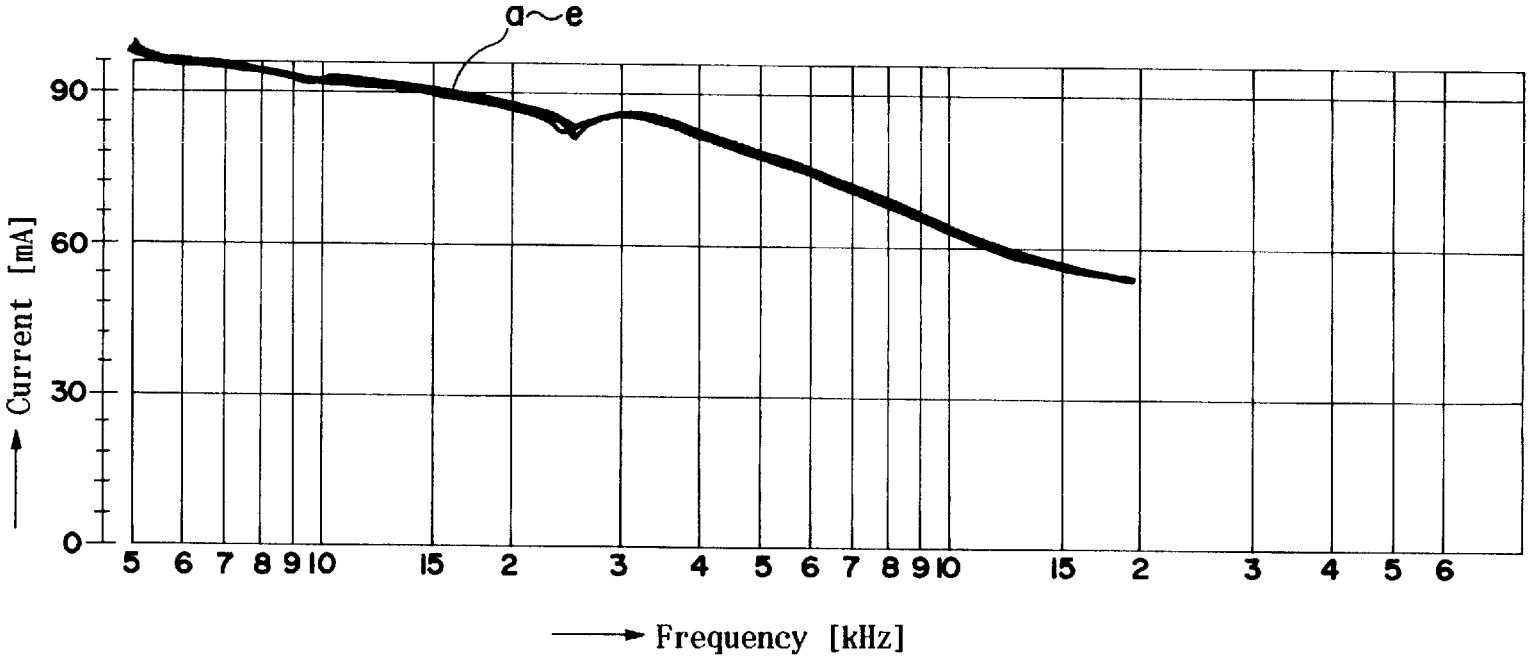
FIG. 17 is a view showing the relationship between a current and a frequency characteristic of the small electroacoustic transducer according to the first to third embodiments of the present invention.
Figure 18:
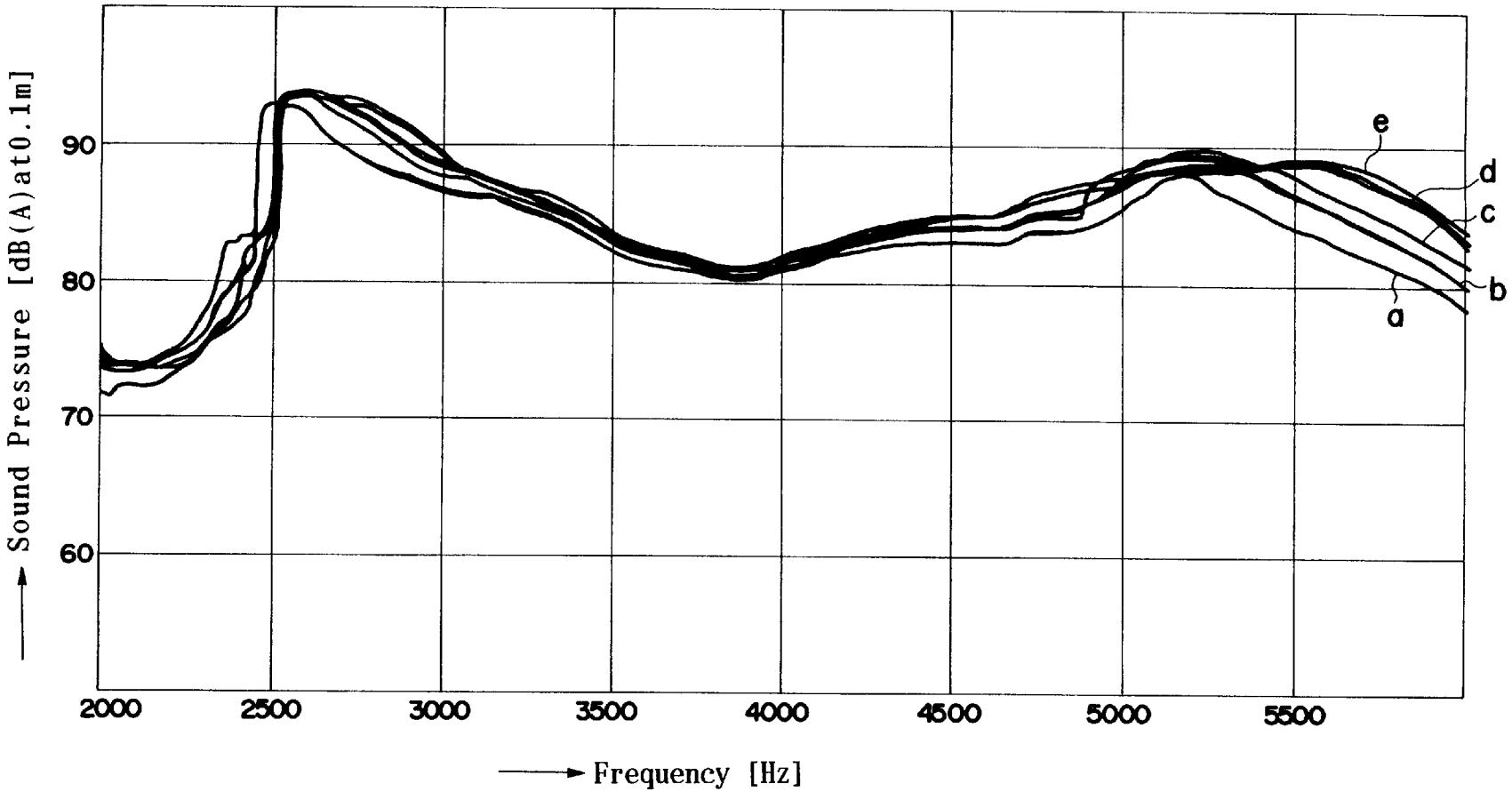
FIG. 18 is a view showing the relationship between a sound pressure and a frequency characteristic of the small electroacoustic transducer in the maximum sound pressure part according to the first to third embodiments of the present invention.
Figure 19:
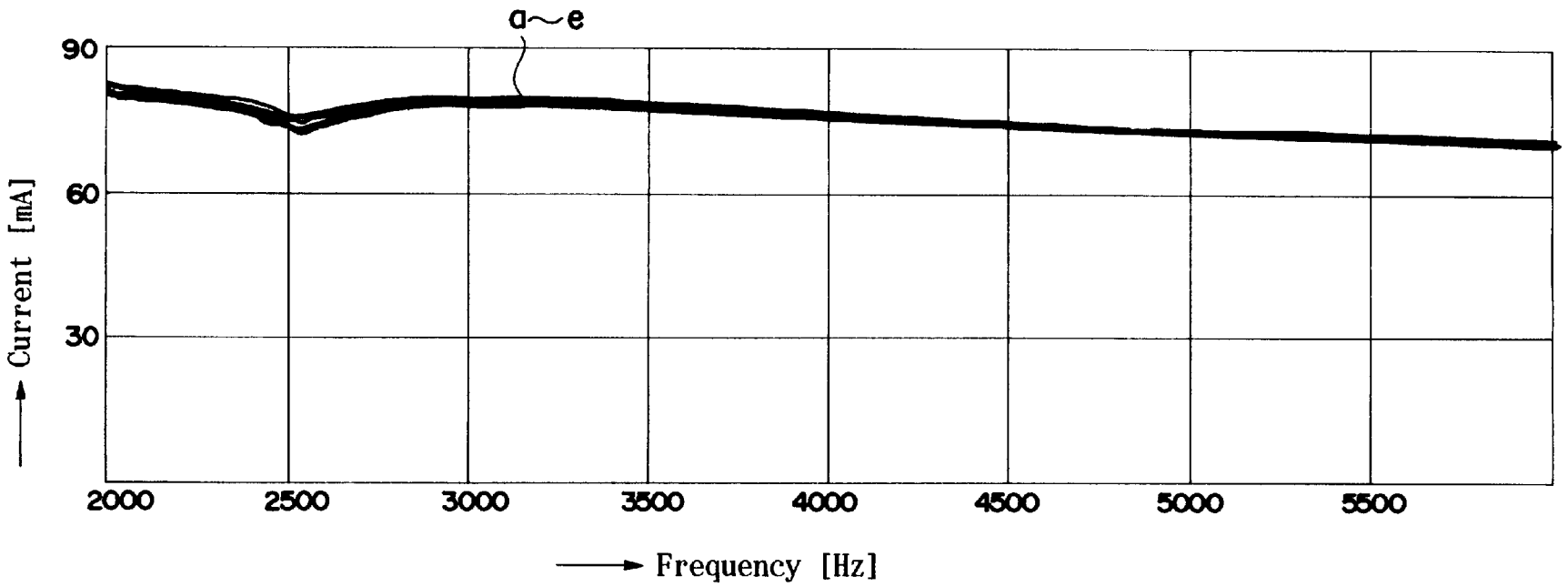
FIG. 19 is a view showing the relationship between a current and a frequency characteristic of the small electroacoustic transducer in the maximum sound pressure part according to the first to third embodiments of the present invention.
Figure 20:
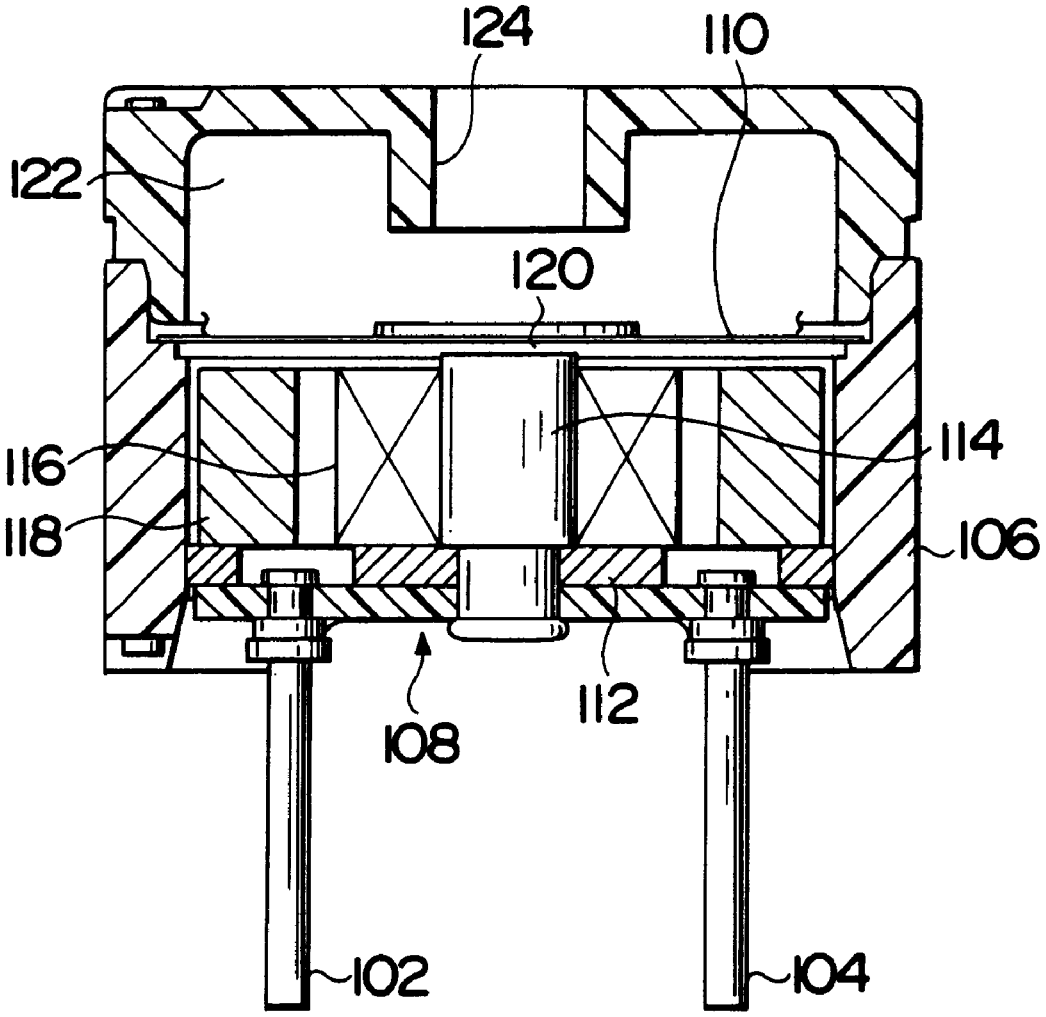
PRIOR ART FIG. 20
FIG. 20 is a longitudinal cross sectional view of a conventional small electroacoustic transducer.

FIG. 16 shows a sound pressure versus frequency characteristic (as a whole) and FIG. 17 shows a current versus frequency characteristic (as a whole). FIG. 18 shows a sound pressure versus frequency characteristic in which the frequency where the maximum sound pressure is obtained and the adjacent frequency are enlarged, and FIG. 19 shows a current versus frequency characteristic in which the frequency where the maximum sound pressure is obtained and the adjacent frequency are enlarged. As a result, each acoustic characteristic corresponds to the sound pressure versus frequency characteristic and the current versus frequency characteristic in the cases of (a) to (e) as shown in FIG. 16 through FIG. 19. Denoted by fo is a resonant frequency inherent to the resonance plate 10, and fv is a resonant frequency inherent to the resonance space.

As evident from these characteristics, it is understood that the sound pressure characteristics is varied when the second resonant chamber 28 is added to the first resonant chamber 24. Accordingly, the sound pressure characteristics can be adjusted by setting the volume and the number of the second resonant chamber 28.

It is possible to obtain the following effects according to the present invention.

(a) When the second resonant chamber is added to the first resonant chamber, the volume of the resonance space of the small electroacoustic transducer can be enlarged and the resonating effect can be enhanced. It is possible to adjust the volume of the resonance space of the small electroacoustic transducer as a whole by the second resonant chamber alone without varying the shape, and volume of the first resonant chamber.

(b) It is possible to arbitrarily set the shape of the resonance space with the external shape of the outer casing in common, thereby enlarging the resonance space with the small electroacoustic transducer.

(c) It is possible to vary the sound pressure characteristic and acoustic characteristic of sound with the external shape of the outer casing in common, thereby reducing the manufacturing cost of the small electroacoustic transducer.

Although the structures and functions of the present invention have been explained with reference to first to third embodiments, the present invention is not limited to the small electroacoustic transducer of these embodiments, but it may include modifications which can be easily worked by a person skilled in the art and the arrangement which can be conjectured to realize the above objects.

What is claimed is:

1. An electroacoustic transducer comprising:

a housing;

means located in the housing for producing an oscillating magnetic field from an inputted signal;

a resonance plate located in the housing, adjacent the field producing means, for vibrating in response to the oscillating magnet field;

a first resonance chamber formed in front of the resonance plate located in the housing and comprising a space defined by the resonance plate, a first wall member, and a second wall member;

at least one second resonance chamber formed in the housing and located radially and outwardly adjacent the first resonance chamber and radially separated therefrom by the second wall member;

an opening formed between each second resonance chamber and the first resonance chamber for communicating the first and second resonance chambers with each other resulting in an increased resonance volume; and a hole located in at least one of the resonance chambers for emitting sound outside the transducer.

2. The transducer set forth in claim 1 wherein the sound emitting hole is located in the first resonance chamber.

3. The transducer set forth in claim 1 wherein the sound emitting hole is located in the second resonance chamber.

4. The transducer set forth in claim 1 wherein a plurality of second resonance chambers are located radially adjacent the first resonance chamber.

5. The transducer set forth in claim 1 wherein the resonance characteristics of the first and second chambers are different.

* * * * *